United States Patent [19]

Burson

[11] Patent Number: 4,531,500

[45] Date of Patent: Jul. 30, 1985

[54] FAIL SAFE IGNITION CUT-OFF SYSTEM

[75] Inventor: Bob O. Burson, Somers, Conn.

[73] Assignee: R. E. Phelon Company, Inc., East Longmeadow, Mass.

[21] Appl. No.: 602,124

[22] Filed: Apr. 19, 1984

[51] Int. Cl.[3] ..... F02P 1/00; F02B 77/00

[52] U.S. Cl. ..... 123/630; 123/198 D; 123/198 DB; 123/599; 123/647

[58] Field of Search ..... 123/602, 599, 198 DC, 123/198 D, 630, 647

[56] References Cited

U.S. PATENT DOCUMENTS

| | | | |
|---|---|---|---|
| 3,553,725 | 1/1971 | Miki | 123/599 |
| 3,809,043 | 5/1974 | Nagasawa | 123/599 |
| 3,964,461 | 6/1976 | Wesemeyer | 123/599 |
| 4,036,201 | 7/1977 | Burson | 123/599 |
| 4,149,509 | 4/1979 | Mathieu | 123/599 |
| 4,233,950 | 11/1980 | Kroiski | 123/630 |
| 4,236,494 | 12/1980 | Fairchild | 123/599 |

*Primary Examiner*—Ronald B. Cox

*Attorney, Agent, or Firm*—Chapin, Neal & Dempsey

[57] ABSTRACT

An electronic, breakerless ignition system with a grounded cut-off switch has a transformer coil and an electronic ignition circuit in a unitary housing fitted on the core. In an inductive embodiment of the system, a trigger coil is in circuit with the base of a Darlington transistor to control the operation of the transistor in response to flux generated voltage in the trigger coil. The primary winding of the transformer coil has one ground connection and the trigger coil is connected to an entirely separate ground terminal. Each of the terminals is fastened at one end to spaced points on the core. In a capacitor discharge ignition embodiment, one end of the primary winding is connected to a ground terminal and a coil for charging the capacitor is connected at one end to a separate ground terminal. Both terminals are separately connected at spaced points to the core and no internal circuit connections are provided between the grounded end of the primary coil and the grounded end of the trigger coil or the charging coil.

7 Claims, 5 Drawing Figures

FAIL SAFE IGNITION CUT-OFF SYSTEM

BACKGROUND OF THE INVENTION

In recent years it has become more and more common place to utilize breakerless ignition systems, of either the inductive or capacitor discharge type with small internal combustion engines, such as used on lawnmowers and chain saws. Because these applications generally require compact systems, it has been the trend to fabricate unitary ignition modules which encapsulate in the same housing both the ignition coil and the electronic control circuit. From the standpoint of economy and ease of fabrication, one ground terminal is invariably used. One such capacitor discharge ignition system (CDI) is disclosed in Burson U.S. Pat. No. 4,036,201 and another in Piteo U.S. Pat. No. 3,484,677 which discloses an inductive type system. In both these patents, assigned to the same assignee as the present application, the coils and the ignition circuit components are shown wired together and, as stated above, a single, common ground connection is employed. In recent installations, these systems have generally included a cut-off or "kill" switch, which when actuated will prevent the system from generation ignition pulses to sustain engine operation. This type of cut-off is usually accomplished by grounding out the primary coil or the charging coil in the CDI system.

To comply with newly enacted safety legislation, engine cut-off must occur in a very brief time interval after the operator's hands release the equipment controls. The concept is that if the operator slips or falls when handling potentially hazardous power equipment, the engine will not continue to run. Occasionally, with a conventional type of unitary module, if for any reason, a common ground terminal connection has broken away, the ignition system would continue to generate ignition pulses and the engine would not stop as required. Such failures of the cut-off mechanism results from the presence of wiring circuit connections within the coil module so that a complete and operative circuit still exists even though the ground connection has become disconnected.

It is the principal object of this invention to provide an ignition system cut-off which will not be rendered ineffective in the event of disconnection of the ground terminal.

It is another object of this invention to provide an ignition system in which a cut-off switch is connected to a first ground terminal and the primary coil and electrical control circuit are each separately connected to two discrete ground terminals, but are not otherwise interconnected.

It is a further object of this invention to provide an ignition system cut-off of the above type in which discrete terminals, each having an inner end in electrically conductive contact with electrically separated points in the module and an outer end, each affixed at spaced points to the core of the ignition system.

The above and other objects and advantages of this invention would be more readily apparent from the following description read in conjunction with the accompanying drawings, in which.

Figure 1:
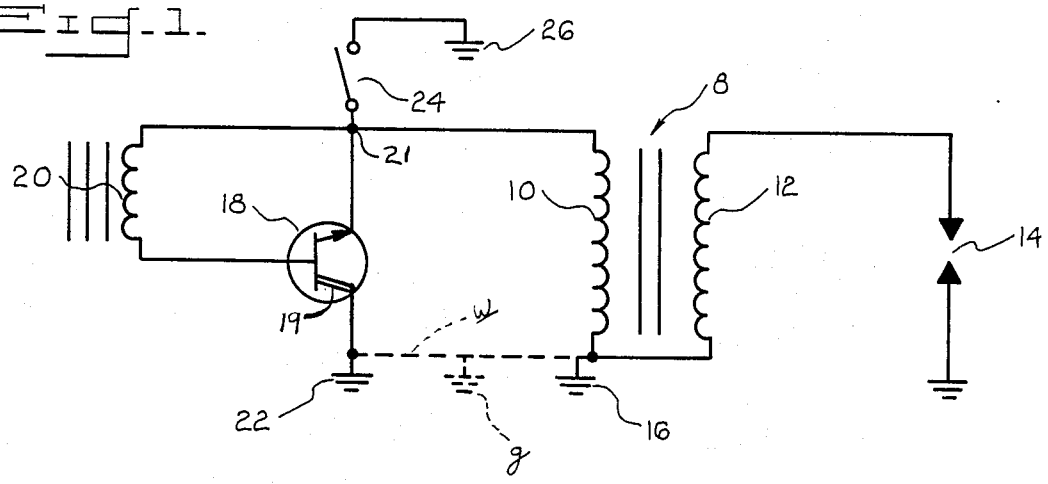
FIG. 1 is a schematic wiring diagram showing one type of inductive ignition system which embodies this invention.
Figure 5:
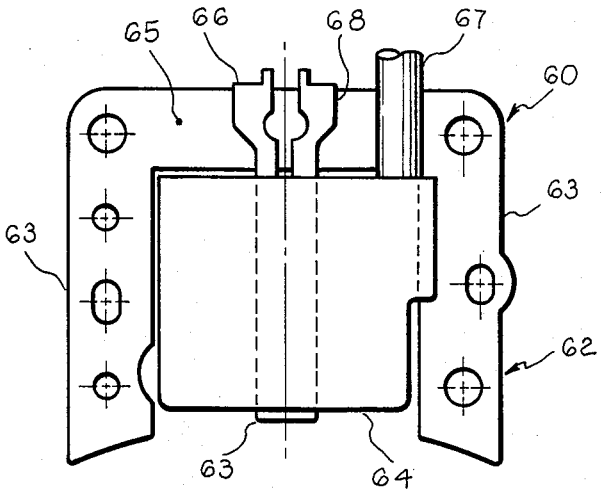
FIG. 5 is an elevational view showing a coil/core module of the type embodying this invention.

Referring in detail to the drawings, in FIG. 1 is shown a schematic wiring or circuit diagram for an inductive type ignition system. As is customary with systems of this type, all the coils and electronic elements are housed within a unitary module, such as depicted in FIG. 5. In such installations, a common ground terminal such as illustrated at g in FIG. 1, is employed and this is connected to coil 10 and switching element 18 by wiring or circuit means as illustrated at w by the broken line construction. U.S. Pat. No. 3,484,677 to Piteo discloses three such earlier types of inductive ignition systems. In each of these circuits, a common ground is utilized for the primary coil, the trigger coil and the electronic components which control the operation of the circuit.

In the previously available systems, when a cut-off or "kill" switch such as 24 is closed, the primary coil is grounded at its opposite ends by ground connections g and 26. If, however, the connection g is disconnected or broken away from its contact with ground, the circuits wiring w from the switching transistor 18 to the primary coil 10 would remain intact and the engine would continue to operate, since the primary coil 10 and the transistor 18 still serve as part of an operaple ignition system.

In FIG. 1, a system embodying this invention comprises an ignition coil 8 which includes the primary winding 10 and a secondary winding 12 connected to a spark-gap device 14. As shown, the lower ends of both the primary and the secondary coils are connected to one ground terminal 16. An electrical switch in the form of a Darlington transistor 18 is connected with its collector-emitter current path in parallel with the primary winding 10. A trigger coil 20 has one end connected to the junction 21 which is also connected to the emitter of the transistor. The other end of the trigger coil 20 is connected to the base of the transistor 18 and the collector 19 is conected to a second ground terminal 22. In operation, voltage from the trigger coil turns "on" transistor 18, and shuts it "off" at the correct instant which causes a collapse in primary current and the resulting flux charge induces an ignition pulse in the secondary coil 12. Other than through the two separate ground terminals 16 and 22, there is no common connection from the grounded end of the primary to the collector 19 of the transistor 18. In other words, there is no longer any connection or circuit means w as heretofore used in such systems. The "kill" switch 24 has one side connected to junction 21 and the other side to the ground terminal 26. To shut "off" of engine operated by the ignition system of FIG. 1, when the "kill" switch 24 is closed such as by releasing the control mechanism of a lawn mower, the primary coil 10 will be grounded and no ignition pulse can thereafter be induced in the secondary winding 12 by changing flux in the primary coil 10.

To prevent the possibility of the engine continuing to run after the cut-off switch 24 has been activated, two completely separate ground terminals 16 and 22 are provided. Terminal 16 is connected to the primary coil 10 and terminal 22 is connected to the collector 19 of transistor 18. Thus, whenever the "kill" switch 24 is closed, no ignition pulse will be generated in the secondary coil 12 even though one or both of these two terminals is disconnected or broken away from its contact with a grounded engine part. In such event, the ground-to-ground circuit path between the transistor and the primary coil is "open" and no pulse will be induced in the secondary coil.

A fail-safe ignition cut-off system is thus provided, whereby disconnection from ground of terminal 16 and/or 22 will absolutely prevent the system from generating an ignition spark which could sustain operation of the engine.

Figure 2:
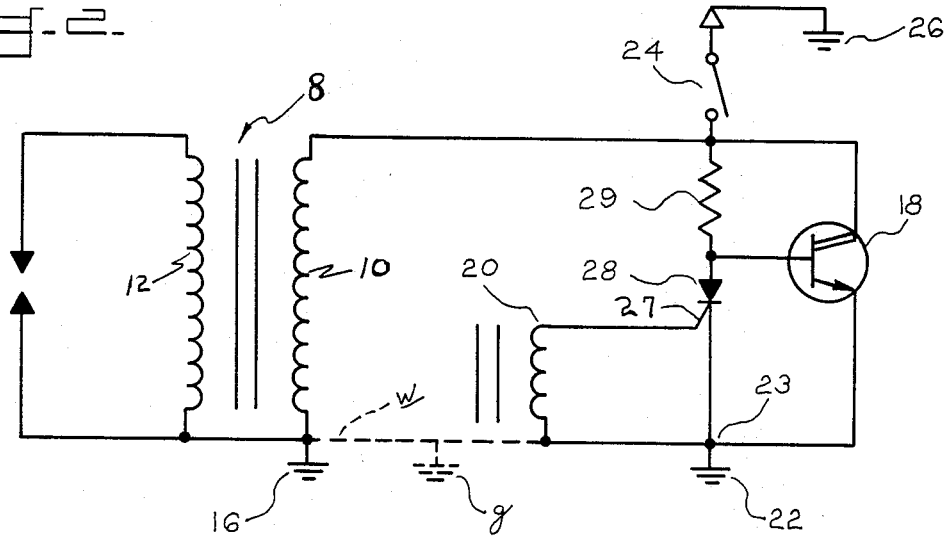
FIG. 2 is a schematic wiring diagram of an alternative type of inductive ignition system embodying this invention.

In FIG. 2, an alternative type of induction system is shown in which like parts to those shown in FIG. 1 are identified by the same reference characters. In this systems, Darlington transistor 18 is controlled by a silicon controlled rectifier (SCR) 28 with trigger-coil 20 connected to the gate electrode 27 of the SCR. A biasing resistor 29 is disposed across the base and the collector of the transistor 18. In prior systems of this type, a common ground terminal g and a circuit connection w between the primary core 10 and trigger coil 20 have been invariably utilized. In the present system, however, the ground terminal 22 is connected to a junction 23 also connected to the cathode of the SCR 28 and to the end of the trigger coil 20 opposite to the end which is connected to the gate 27 of the SCR. The voltage pulses induced in trigger coil 20 cause the transistor 18 to turn "on" and then at the proper instant to be cut "off" so that the collapse of primary current through the transistor 18 will induce an ignition pulse in the secondary coil 12. In a manner similar to that of FIG. 1, if terminal 16 and/or 22 is broken or disconnected from ground, no ignition pulse will be generated in the secondary coil because the primary coil will either be grounded or an open circuit will occur in the primary coil-Darlington path.

Figure 3:
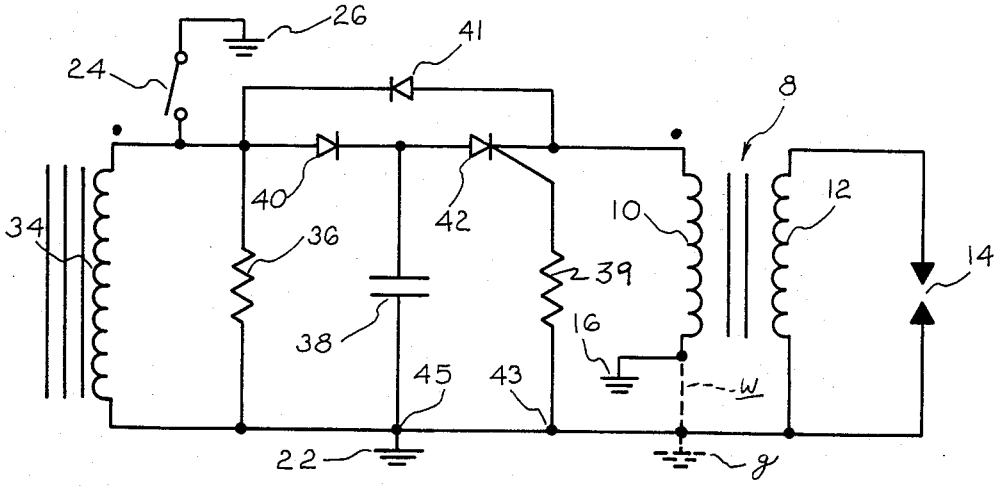
FIG. 3 is a schematic wiring diagram of one type of capacitor discharge ignition system embodying this invention.

In FIG. 3, a capacitor discharge ignition system (CDI) is shown which comprises a charging coil 34 with a resistor 36 connected across the ends of the charge coil. A capacitor 38 is also connected across the coil 34 and is charged by the output generated in the charge coil 34 as a permanent magnet (not shown) generates past the coil. Diode 40 is poled to pass positive voltage pulses to charge the capacitor 38 and to prevent the capacitor from discharging back through the charge coil 34 on the negative half-cycles of voltages generated in the charge coil. Burson U.S. Pat. No. 4,036,201 discloses a similar type of capacitor discharging ignition system. In previous circuits of this type, a common ground terminal g and circuit connection w were utilized. The CDI system also includes a silicon controlled rectifier (SCR) 42 having its anode/cathode path connected to one end of the primary coil 10, the opposite end of the coil being connected to one ground terminal 16. The gate of the SCR is connected through the resistor 39 to junction 43 which is interconnected with the secondary coil 12 and to junction 45 disposed in circuit between capacitor 38 and a second ground terminal 22.

In operation, a rotating magnet (not shown) will generate alternating voltage in charge coil 34 which will cause capacitor 38 to be charged on one-half cycle and on the next halfcycle, SCR 42 will be gated "on" and the capacitor will discharge the stored voltage through the primary coil 10 and an ignition pulse will, by flux change thereupon, be induced in secondary coil 12. The ground terminals 16 and 22 of this system are separate and not connected together by any common wire or connection except through the ground itself. When "kill" switch 24 is closed, the charge coil 34 is grounded "out" by ground terminals 22 and 26 and the capacitor 38 will not, thereafter, be charged. As a result, no ignition pulse will be generated. If for any reason, either or both of the ground terminals 16 and 22 are broken, disconnected or severed from the grounding component, the system will still not produce an ignition pulse because the primary coil will be grounded out or the circuit from the primary coil to the capacitor 38 will remain "open" and no current can flow through the primary coil to induce an ignition pulse in the secondary coil 12.

Figure 4:
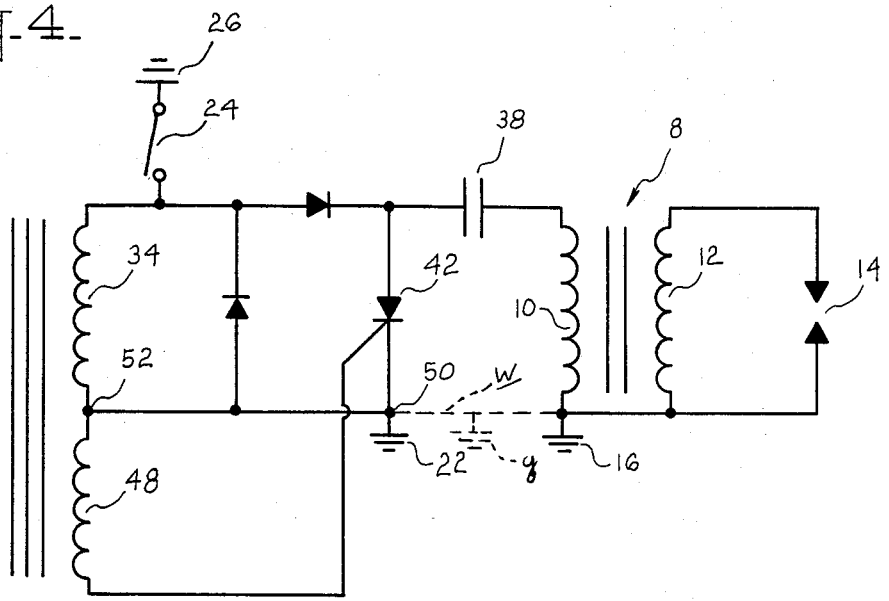
FIG. 4 is a schematic diagram showing an alternative capacitor discharge ignition system embodying this invention.

In FIG. 4 is shown a modified type of capacitor discharging ignition system which includes a separate trigger coil 48 connected to the gate of SCR 42. The previous common ground terminal and circuit wiring are illustrated at g and w in dotted lines. If terminal 16 and/or 22 is disconnected from ground, the ignition circuit will not function for the same reason as heretofore described.

A typical coil-core stator assembly 60 is shown in FIG. 5 for use with ignition systems of the type embodying this invention. The stator assembly comprises a laminated flux carrying core 62 having three leg portions 63 and a cross-bar portion 65 adapted to carry flux generated by magnet means rotated past the open, arcuate end surfaces of the core legs. The ignition coil and electronic control circuits, heretofore described, may be encapsulated within a unitary housing or module 64 which is shown mounted on the center leg of the core. A high-tension wire 67 extends from the coil module for connection to the spark plug of an internal combustion engine.

Extending outwardly from the inner end of the coil module is a pair of generally flat metallic strips 66 and 68. These strips serve as the ground terminals represented schematically at 16 and 22 of FIGS. 1–4. One of the strips correspond to terminal 16 and is connected at its inner end to one of the primary coil and the other strip corresponds to terminal 22 and is connected at its inner end to either the collector of transistor 18 (FIG. 1), junction 23 for FIG. 2, junction 45 for FIG. 3 and junction 50 for FIG. 4. The outer or exposed ends of each of the metallic strips 66 and 68 are securely welded onto the outer surface of the cross-bar portion 65 of the laminated core 62. With this construction, two separate and distinct ground terminals are provided, each being securely fastened at its outer end to the core 60 which is, in turn, fastened to the engine housing. Other than their individual connection to the two separate ground terminals 66 and 68, there is no other electrical connection of these circuit points within the circuit module. The only electrical connection between these two points is thus from one terminal 66 through the core 60 and then to the other terminal 68. Thus, if either ground terminal is disconnected from the core, an open circuit will result and the ignition system will not generate a spark to cause engine operation. As a result whenever the "kill" switch is closed, even if one or both of the ground terminals is disconnected, engine operation cannot be sustained.

Having thus disclosed this invention, what is claimed is:

1. In a breakerless electronic ignition system having an ignition transformer with inductively coupled primary and secondary windings disposed on a ferromagnetic, flux carrying core and with an electronic switching circuit disposed within a unitary housing with said transformer for controlling the current flow in the primary winding in response to rotation of a permanent magnet past the core, the improvement comprising a cut-off switch having one side connected to the electronic circuit and the other side connected to a grounded terminal, a second ground terminal connected to one end of the primary winding within said housing and a third ground terminal connected to said electronic circuit at a point electrically separated, within said housing from the connection of the second terminal to the primary winding, said terminals having other ends connected to a grounded structure externally of said housing whereby said ignition system will be grounded out or open circuited despite the disconnection of either or both of said second and third ground terminals.

2. In a breakerless electronic ignition system as set forth in claim 1, in which the inner end of said second terminal is connected to one end of said primary winding and the inner end of said third terminal is separately connected to said electronic switching circuit, the outer ends of said second and third terminals being affixed two spaced points on said core.

3. In a breakerless electronic ignition system as set forth in claim 2, in which the second ground terminal is an elongated strip having its inner end electrically connected to one end of the primary winding within said housing and the third terminal is an elongated strip which is connected at its inner end to a junction within said housing, said junction being connected by circuit means to another coil in said housing.

4. In a breakerless electronic ignition system as set forth in claim 3, in which said other coil is a trigger coil for an inductive ignition system and said circuit means includes an electronic switching component.

5. In a breakerless electronic ignition system as set forth in claim 3, in which said other coil is a coil for charging a capacitor in a capacitor discharged ignition system and said circuit means includes a silicon controlled rectifier, said junction being connected to the gate electrode thereof.

6. In a breakerless electronic ignition system as set forth in claim 4, in which said switching component is a Darlington transistor.

7. In a breakerless electronic ignition system as set forth in claim 4, in which said switching component is a silicon controlled rectifier.

* * * * *